US011796942B2

(12) United States Patent
Takahashi et al.

(10) Patent No.: US 11,796,942 B2
(45) Date of Patent: Oct. 24, 2023

(54) FIXING DEVICE INCLUDING GROUND CONTACT THAT GROUNDS HEAT ROLLER

(71) Applicant: KYOCERA Document Solutions Inc., Osaka (JP)

(72) Inventors: Hironori Takahashi, Osaka (JP); Hironori Yamauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/828,985

(22) Filed: May 31, 2022

(65) Prior Publication Data

US 2022/0382193 A1 Dec. 1, 2022

(30) Foreign Application Priority Data

May 31, 2021 (JP) ..... 2021-091374

(51) Int. Cl.
*G03G 15/20* (2006.01)
*G03G 21/16* (2006.01)
*G03G 15/00* (2006.01)

(52) U.S. Cl.
CPC ..... *G03G 15/2053* (2013.01); *G03G 15/2017* (2013.01); *G03G 21/1652* (2013.01); *G03G 15/2064* (2013.01); *G03G 15/5004* (2013.01)

(58) Field of Classification Search
CPC ..... G03G 21/1652; G03G 15/2017; G03G 15/5004
See application file for complete search history.

(56) References Cited

U.S. PATENT DOCUMENTS 8,843,013 B2 * 9/2014 Sawamura ..... G03G 15/2053 399/323
9,069,305 B2 * 6/2015 Suzuki ..... G03G 15/2053
10,379,484 B2 * 8/2019 Koyama ..... G03G 15/80

FOREIGN PATENT DOCUMENTS

JP H06-103975 A 4/1994
JP H07-311507 A 11/1995
JP 2005338628 A * 12/2005
JP 2008052181 A * 3/2008
JP 2008287122 A * 11/2008
JP 2016106273 A * 6/2016
JP 2018004935 A * 1/2018

* cited by examiner

*Primary Examiner* — Arlene Heredia
(74) *Attorney, Agent, or Firm* — Studebaker & Brackett PC

(57) ABSTRACT

A fixing device heats and fixes a toner image formed on a sheet to the sheet. The fixing device includes a heat roller and a ground contact. The heat roller heats the toner image formed on the sheet. The ground contact grounds the heat roller. The ground contact includes a first electrical conductive member, a second electrical conductive member, and an electrical insulating member. The first electrical conductive member is electrically connected to the heat roller. The second electrical conductive member is positioned opposite the first electrical conductive member and grounds the heat roller. The electrical insulating member is interposed between the first electrical conductive member and the second electrical conductive member and insulates the first electrical conductive member and the second electrical conductive member from each other.

7 Claims, 6 Drawing Sheets

FIXING DEVICE INCLUDING GROUND CONTACT THAT GROUNDS HEAT ROLLER

INCORPORATION BY REFERENCE

The present application claims priority under 35 U.S.C. § 119 to Japanese Patent Application No. 2021-091374, filed on May 31, 2021. The contents of this application are incorporated herein by reference in their entirety.

BACKGROUND

The present disclosure relates to a fixing device.

A general fixing device prevents damage to a heater.

SUMMARY

A fixing device according to an aspect of the present disclosure is a fixing device that heats and fixes a toner image formed on a sheet to the sheet. The fixing device includes a heat roller and a ground contact. The heat roller heats the toner image formed on the sheet. The ground contact grounds the heat roller. The ground contact includes a first electrical conductive member, a second electrical conductive member, and an electrical insulating member. The first electrical conductive member is electrically connected to the heat roller. The second electrical conductive member is positioned opposite the first electrical conductive member and grounds the heat roller. The electrical insulating member is interposed between the first electrical conductive member and the second electrical conductive member, and insulates the first electrical conductive member and the second electrical conductive member from each other.

DETAILED DESCRIPTION

Figure 1:
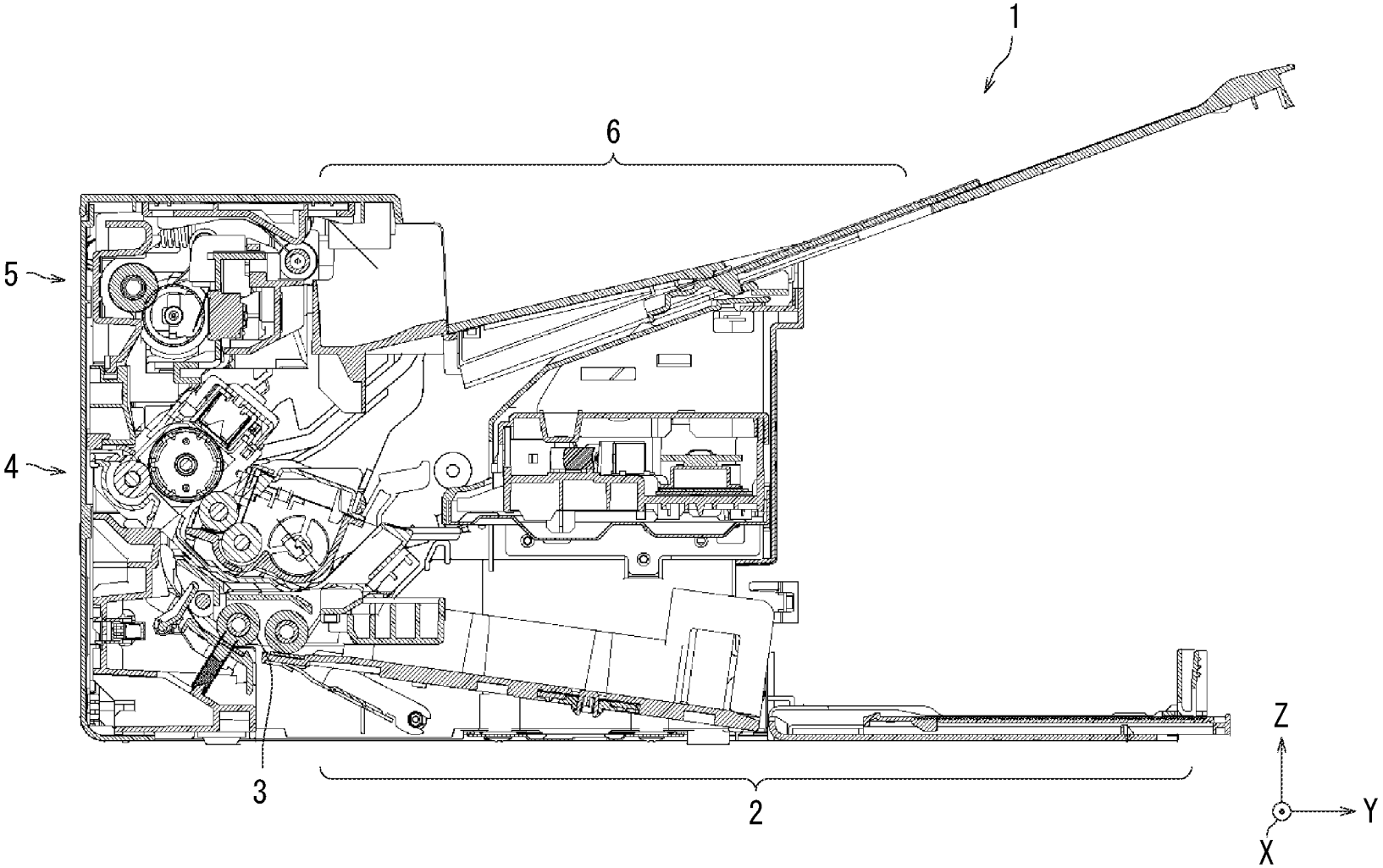
FIG. 1 illustrates an image forming apparatus including a fixing device according to an embodiment of the present disclosure.

An embodiment of the present disclosure will hereinafter be described with reference to the accompanying drawings. Note that elements which are the same or equivalent are labelled the same reference signs in the drawings and description thereof is not repeated. In the present embodiment, mutually orthogonal X-, Y-, and Z-axes are illustrated in the drawings. The Z-axis is parallel to a vertical plane, and the X- and Y-axes are parallel to a horizontal plane.

In the present embodiment, a conveyance direction of a sheet in an image forming section 4 may be described as a sub-scanning direction. The X-axis direction orthogonal to the sub-scanning direction may be described as a main scanning direction.

Figure 2:
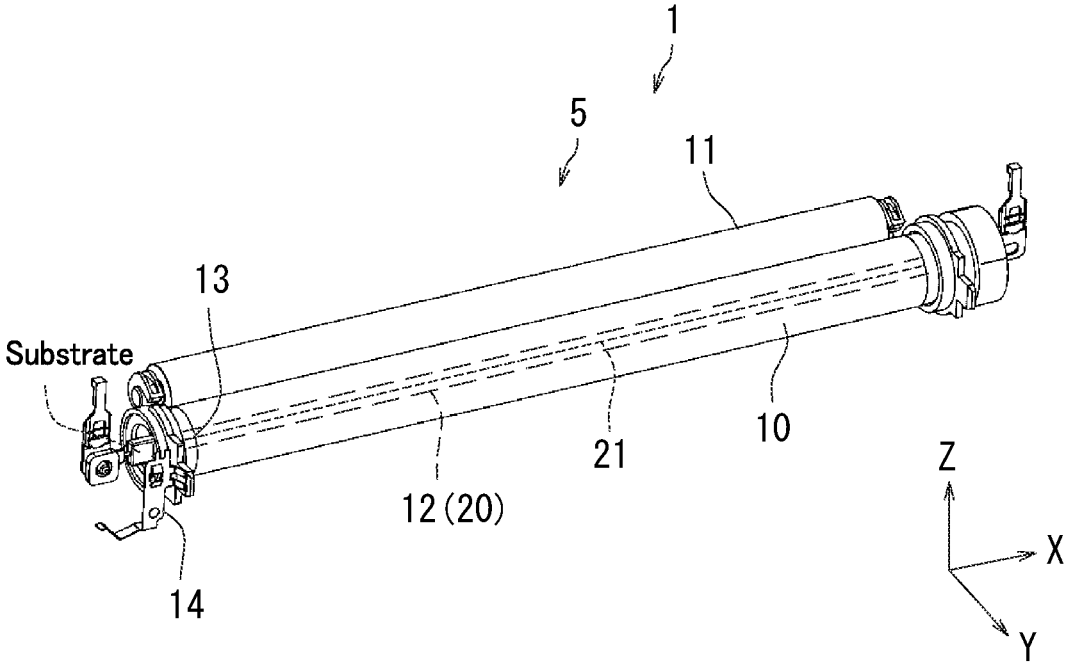
FIG. 2 illustrates a structure of the fixing device according to the embodiment of the present disclosure.
Figure 3:
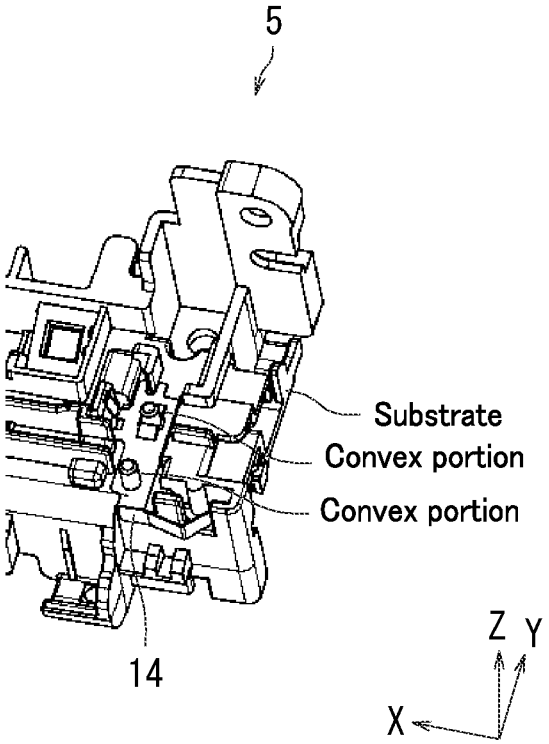
FIG. 3 illustrates a comparison example with the fixing device according to the present embodiment.
Figure 4:
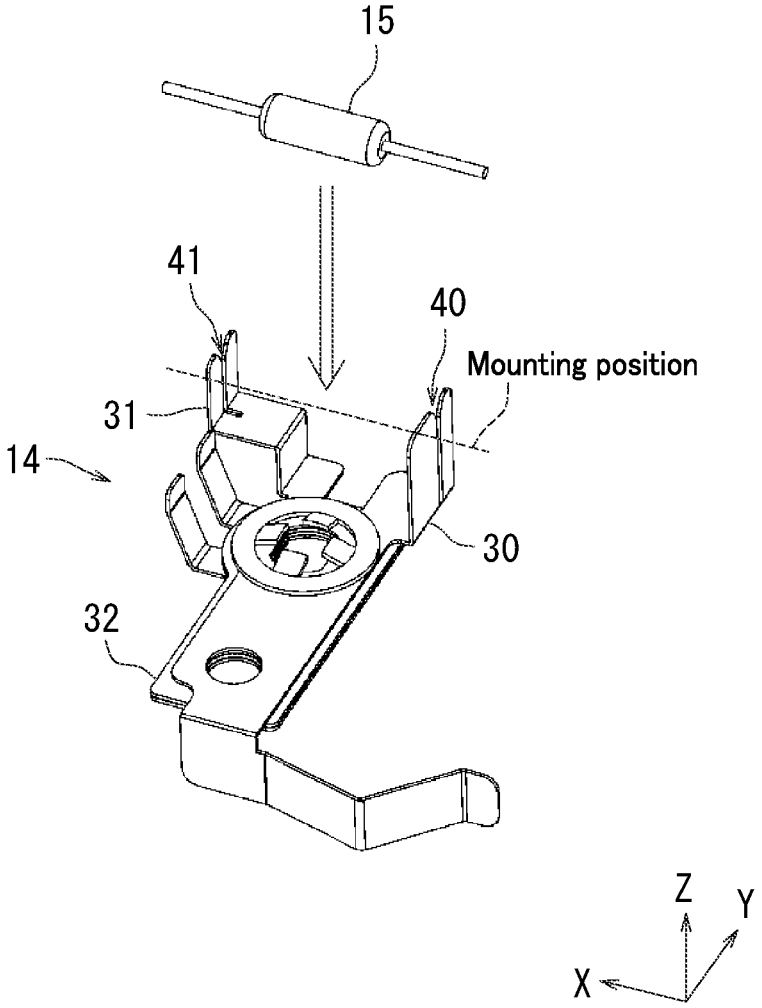
FIG. 4 illustrates a detailed structure of the fixing device according to the embodiment of the present disclosure.
Figure 5:
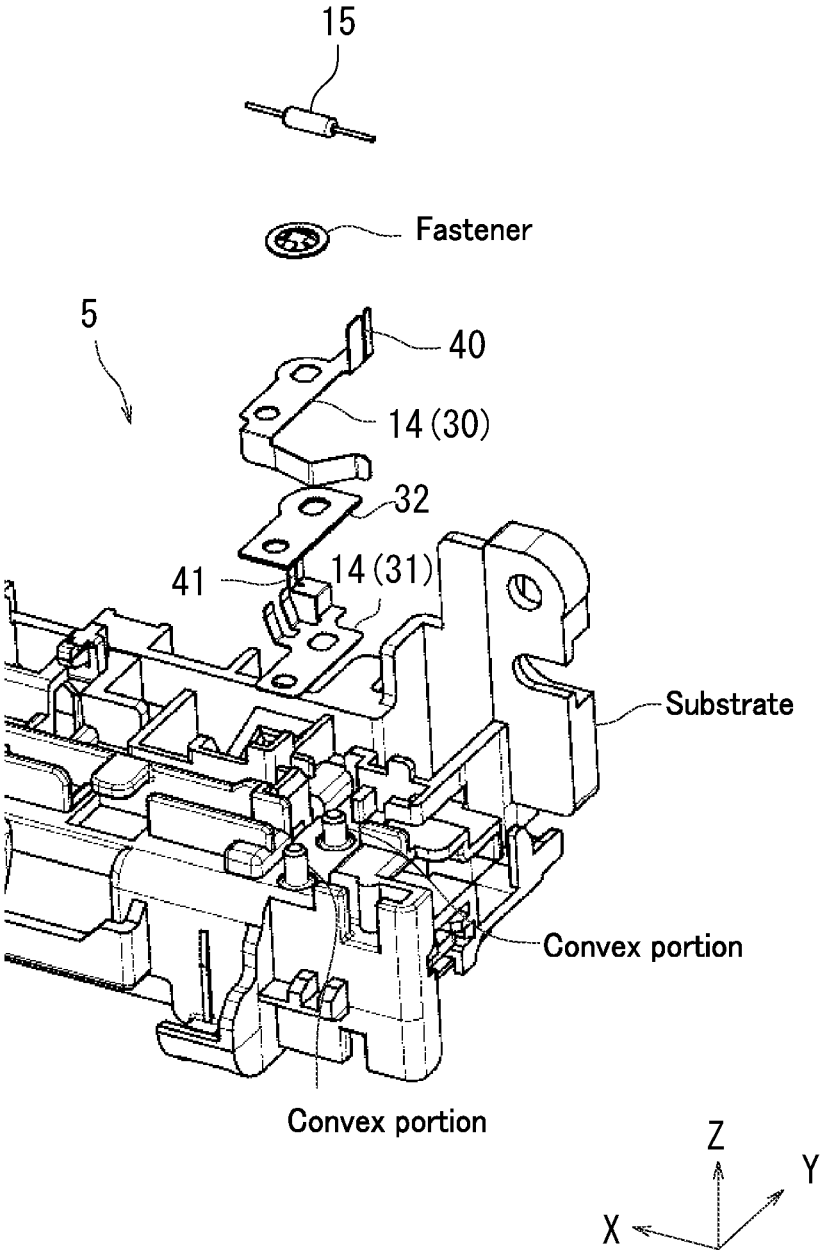
FIG. 5 illustrates a detailed structure of the fixing device according to the embodiment of the present disclosure.
Figure 6:
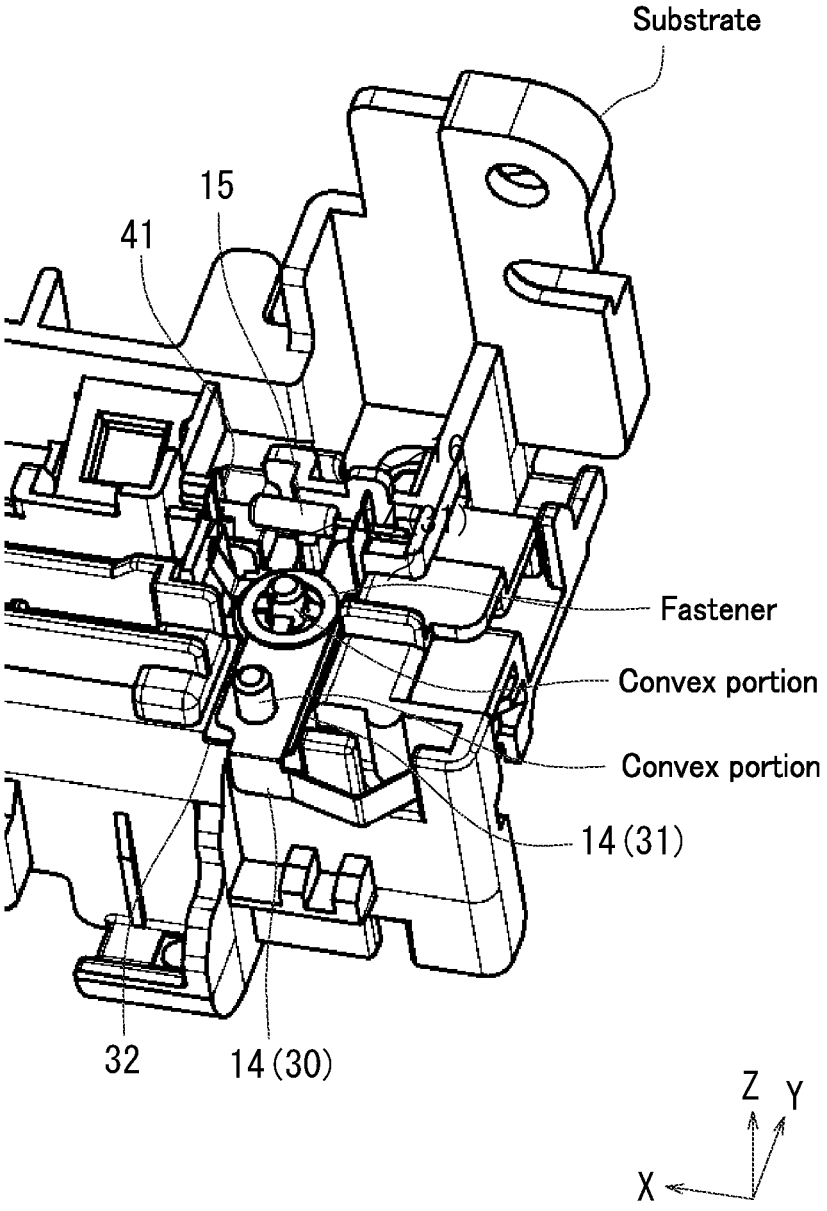
FIG. 6 illustrates a detailed structure of the fixing device according to the embodiment of the present disclosure.

An image forming apparatus 1 including a fixing device 5 according to the embodiment of the present disclosure will be described with reference to FIGS. 1 to 6. FIG. 1 illustrates the image forming apparatus 1 including the fixing device 5 according to the embodiment of the present disclosure. FIG. 2 illustrates a structure of the fixing device 5 according to the embodiment of the present disclosure. FIG. 3 illustrates a comparison example with the fixing device 5 according to the present embodiment. FIGS. 4 to 6 each illustrate a detailed structure of the fixing device 5 according to the embodiment of the present disclosure.

The image forming apparatus 1 in the present embodiment is a type of electrophotographic image forming apparatus and includes a sheet feeding section 2, a sheet conveyance device 3, the image forming section 4, the fixing device 5, a sheet ejecting section 6, a power supply section, a driver, and a controller.

The sheet feeding section 2 includes, for example, a sheet tray and a pickup roller.

The sheet conveyance device 3 includes, for example, a conveyance path, conveyance rollers, and a conveyance motor.

The sheet is conveyed in the conveyance path.

The conveyance rollers are arranged in the conveyance path and conveys the sheet.

The conveyance motor drives the conveyance roller in a rotational manner.

Next, as illustrated in FIG. 1, the image forming section 4 forms a toner image (not illustrated) on the sheet based on document image data.

The image forming section 4 includes, for example, an image data acquisition section, a photoconductor drum, a charger, an exposure device, a development device, a transfer device, and a cleaner.

The image data acquisition section acquires image data from, for example, a scanner, a personal computer, a server, a cloud, or the like. The image data acquisition section can be realized by ASIC as an example.

The photoconductor drum is in the shape of a drum with a rotation axis. The photoconductor drum rotates about the rotation axis. The photoconductor drum has a photosensitive layer on the outer peripheral surface side.

The charger charges the photosensitive layer of the photoconductor drum at a predetermined potential.

The exposure device directs a laser beam to the photosensitive layer of the photoconductor drum to expose the photosensitive layer. The exposure device exposes the photoconductor drum based on the image data. As a result, an electrostatic latent image is formed on the photoconductor drum. Examples of the exposure device include light emitting diodes (LEDs).

In an example, the development device stores a dual-component developer containing carriers made of a magnetic material and toner. The development device develops the electrostatic latent image formed on the photoconductor drum with the toner to form the toner image on the photoconductor drum.

The transfer device transfers the toner image on the photoconductor drum to the sheet.

The cleaner removes the residual toner remaining on the photoconductor drum after transfer. The sheet on which the toner image is formed by the image forming section 4 is conveyed to the fixing device 5.

Next, the fixing device 5 will be described with reference to FIG. 2. The fixing device 5 heats and fixes the toner image formed on the sheet to the sheet.

The fixing device 5 further includes a heat roller 10 and electrical conductive bearings 13. The heat roller 10 heats the toner image formed on the sheet. The electrical conductive bearings 13 support the heat roller 10 with the heat roller 10 allowed to turn freely.

As illustrated in FIG. 2, the fixing device 5 includes the heat roller 10, a press roller 11, a heater 12, the electrical conductive bearing 13, a ground contact 14, and a cut-off member 15. The ground contact 14 and the cut-off member 15 will be described in detail with reference to FIGS. 4 to 6.

The heat roller 10 heats the toner image formed on the sheet. The heat roller 10 is a hollow cylindrical roller. The heat roller 10 is just one example and may be a belt.

The press roller 11 presses against the heat roller 10 to form a nip portion together with the heat roller 10. The press roller 11 is driven in a rotational manner through the driver, thereby rotating the heat roller 10 with the nip portion formed between the heat roller 10 and the press roller 11.

The sheet passes through the nip portion formed between the heat roller 10 and the press roller 11. The toner image formed on the sheet passing through the nip portion is heated by the heat roller 10. The heat-melted toner is transferred on the sheet with the press roller 11 so that a toner image is formed on the sheet.

The fixing device 5 further includes the heater 12. The heater 12 is supplied with electric power from the power supply section (not illustrated) to generate heat, thereby heating the heat roller 10.

The heater 12 is supplied with electric power from the power supply section to heat the heat roller 10. The heater 12 is placed close to the inner peripheral surface of the heat roller 10. The sheet conveyed to the sheet conveyance device 3 is heated by the heater 12 while passing through the nip portion, whereby the toner image is fixed.

The heater 12 may include a halogen lamp 20 and a filament 21. The filament 21 is supplied with electric power from the power supply section to generate heat. The filament 21 is arranged inside the halogen lamp 20. That is, the halogen lamp 20 includes the filament 21 that is arranged in the longitudinal direction in a glass tube which is formed in a substantially rod shape (substantially columnar shape) in which a halogen gas is sealed. The filament 21 is wound in a coil shape.

The halogen lamp 20 further includes a pair of electrode portions at both ends, in the axial direction, of the glass tube. The filament 21 is connected to the pair of electrode portions. The filament 21 is supplied with electric power from the power supply section via the pair of electrode portions to generate heat.

The filament 21 is made of tungsten, for example. When an electric current flows through the filament 21, the filament 21 is heated to 2,000 and several hundred degrees Celsius by the electric resistance of the filament 21 itself and becomes incandescent.

The halogen lamp 20 heats the heat roller 10 from the inside by utilizing the light in the infrared region radiated from the filament 21. Instead of this, a carbon heater or the like may be employed for the halogen lamp 20.

The controller (not illustrated) controls power supply to the heater 12 from the power supply section. The controller turns on and off the power supply section configured to supply electric power to the heater 12. The controller adjusts the amount of electric current flowing through the filament 21 so that the surface temperature of the heat roller 10 becomes 160° C. to 180° C., for example.

As illustrated in FIG. 2, the electrical conductive bearing 13 supports the heat roller 10 with the heat roller 10 allowed to rotate freely.

Next, the ground contact 14 and the cut-off member 15 will be described in detail with reference to FIGS. 4 to 6.

First, the ground contact 14 grounds the heat roller 10. As illustrated in FIGS. 4 and 5, the ground contact 14 includes a first electrical conductive member 30, a second electrical conductive member 31, and an electrical insulating member 32.

As illustrated in FIG. 4, the first electrical conductive member 30 may have a first slit 40. The second electrical conductive member 31 may have a second slit 41.

The first electrical conductive member 30 (first leaf spring 30) is electrically connected to the heat roller 10. The second electrical conductive member 31 (second leaf spring 31) is positioned opposite the first electrical conductive member 30 and grounds the heat roller 10.

The first electrical conductive member 30 may be described as the first leaf spring 30. That is, the first electrical conductive member 30 may be a leaf spring with electrical conductivity. The first electrical conductive member 30 may be made of stainless steel, nickel, molybdenum, copper or the like.

The first electrical conductive member 30 is electrically connected to the heat roller 10.

The electrical insulating member 32 (electrical insulating sheet 32) is interposed between the first electrical conductive member 30 and the second electrical conductive member 31, and insulates the first electrical conductive member 30 and the second electrical conductive member 31 from each other.

The electrical insulating member 32 may be described as the electrical insulating sheet 32. That is, the electrical insulating member 32 may be a sheet member. The electrical insulating member 32 is made of a polyimide epoxy resin, for example.

The electrical insulating member 32 is a sheet member having a predetermined thickness, and interposed between the first electrical conductive member 30 that faces a first surface of the electrical insulating member 32 and the second electrical conductive member 31 that faces a second surface of the electrical insulating member 32. Of the electrical insulating member 32, the first surface facing the first electrical conductive member 30 may be positioned at a distance of, for example 0.5 mm from the second surface facing the second electrical conductive member 31.

The ground contact 14 suppresses, through electrical insulating member 32, an overcurrent that is generated by the heater 12 touching the electrical conductive bearing 13 to flow through the electrical conductive bearing 13. The ground contact 14 suppresses, through electrical insulating member 32, an overcurrent that is generated by electric power supplied to the heater 12 to flow through the electrical conductive bearing 13.

The ground contact 14 suppresses an overcurrent that is generated by the filament 21 touching the heat roller 10 to flow through the electrical conductive bearing 13. The ground contact 14 suppresses an overcurrent that is generated by the filament 21 touching the electrical conductive bearing 13 to flow through the electrical conductive bearing 13.

The cut-off member 15 is arranged between the first electrical conductive member 30 and the second electrical conductive member 31, and cuts off the overcurrent flowing through the fixing device 5.

The first slit 40 in the first electrical conductive member 30 supports a first end of the cut-off member 15.

The first electrical conductive member 30 is electrically connected to the electrical conductive bearing 13.

The second electrical conductive member 31 may be described as the second leaf spring 31. That is, the second electrical conductive member 31 may be a leaf spring with electrical conductivity. The second electrical conductive member 31 may be made of stainless steel, nickel, molybdenum, copper or the like.

The second slit 41 of the second electrical conductive member 31 supports a second end of the cut-off member 15.

The first end of the cut-off member 15 is attached to the first slit 40 of the first electrical conductive member 30, and the second end of the cut-off member 15 is attached to the second slit 41 of the second electrical conductive member 31. As a result, the cut-off member 15 is mounted at the mounting position illustrated by the dotted line in FIG. 4.

Next, the function performed by the ground contact 14 of the fixing device 5 according to the present embodiment will be described.

As described above in FIG. 2, the heater 12 is placed inside the heat roller 10, and the filament 21 is placed in the halogen lamp 20 constituting the heater 12.

The halogen lamp 20 is often made of a glass tube. Therefore, the halogen lamp 20 may be damaged as a result of the fixing device 5 being dropped or the like.

If the halogen lamp 20 is damaged as a result of the fixing device 5 being dropped or the like, the filament 21 placed inside the halogen lamp 20 is exposed and may come into contact with the inner peripheral surface of the heat roller 10 made of a metal member.

Here, reference is made to the comparison example of FIG. 3. In FIG. 3, a single leaf spring grounds a fixing device 5. In this case, if a filament 21 comes into contact with the inner peripheral surface of a heat roller 10, an electric current flows from the filament 21 through an electrical conductive bearing 13 grounded by a ground member. As a result, the electrical conductive bearing 13 may ignite due to an overcurrent.

As a measure to prevent ignition of the electrical conductive bearing 13, it is conceivable to provide the ground member with the cut-off member 15 such as a fuse as illustrated in FIG. 4. However, the cut-off member 15 such as a fuse may fall off from the ground member due to vibration or dropping of the image forming apparatus 1.

If the cut-off member 15 such as a fuse falls off from the ground member, the electrical conductive bearing 13 cannot be grounded.

Therefore, the present embodiment has a configuration that fulfills the function of ground as illustrated in FIG. 5. As the configuration, two leaf springs of the first electrical conductive member 30 and the second electrical conductive member 31 are provided, and the electrical insulating member 32 is placed together with the cut-off member 15 between the first electrical conductive member 30 and the second electrical conductive member 31.

The electrical insulating member 32 is a thin sheet member and placed between the first electrical conductive member 30 and the second electrical conductive member 31. In this structure, if the cut-off member 15 such as a fuse falls off from the fixing device 5, an electrical discharge occurs in the gap formed by the electrical insulating member 32 between the first electrical conductive member 30 and the second electrical conductive member 31 when the side of the first electrical conductive member 30 becomes a high voltage potential. It is therefore possible to prevent the heat roller 10 from being charged and becoming in a high potential state.

Here, when the electrical insulating member 32 has a thick structure, the insulating properties between the first electrical conductive member 30 and the second electrical conductive member 31 are improved. However, the surface potential of the heat roller 10 rises to 4 to 5 kV due to charging, so that image defects are likely to occur in the toner image of the sheet.

On the other hand, in FIG. 4, the cut-off member 15 such as a fuse is attached to the first electrical conductive member 30 and the second electrical conductive member 31. In this case, because the cut-off member 15 electrically connects the first electrical conductive member 30 and the second electrical conductive member 31, the heat roller 10 with an electric charge is grounded via the electrical conductive bearing 13. As a result, the surface potential of the heat roller 10 is suppressed to 100 V to 500 V as an example.

In the present embodiment, the thin sheet electrical insulating member 32 is arranged between the first electrical conductive member 30 and the second electrical conductive member 31 to be insulated from each other. Even if the cut-off member 15 such as a fuse falls off from the fixing device 5 and an electric charge of the heat roller 10 becomes excessive, part of the electric charge is discharged between the first electrical conductive member 30 and the second electrical conductive member 31 to flow to ground. As a result, the surface potential of the heat roller 10 during the image forming operation is suppressed to about 1.5 kV or less as an example.

It is therefore possible to prevent the electrical conductive bearing 13 from igniting at a normal AC voltage of 240 V. Although the surface potential of the heat roller 10 charged during the image forming operation rises from 100 to 500 V to a maximum of 1.5 kV, the voltage thereacross is lower than that at the time of insulation without grounding at all, so that the image defect is minor.

Next, as illustrated in FIG. 5, the fixing device 5 includes a housing. The ground contact 14 is mounted in the housing. Convex portions that allow the ground contact 14 to be attached to are provided with the housing of the fixing device 5. The first electrical conductive member 30, the second electrical conductive member 31, and the electrical insulating member 32 each have holes that allow the convex portions to fit into.

The first electrical conductive member 30, the electrical insulating member 32, and the second electrical conductive member 31 of the ground contact 14 are stacked in this order from the side farther from the housing of the fixing device 5, and fastened with a fastener as illustrated in FIG. 6.

The outer shape of the electrical insulating member 32 is formed to be slightly larger than the outer shape of facing surfaces, which face the electrical insulating member 32, of the first electrical conductive member 30 and the second electrical conductive member 31. The diameters of the holes of the first electrical conductive member 30, the second electrical conductive member 31, and the electrical insulating member 32 into which the convex portions are fitted are formed to be larger than the diameters of the convex portions by a fitting tolerance. The first electrical conductive member 30 and the second electrical conductive member 31 may be separated from each other at the outer edge of the facing surfaces thereof in the stacked direction due to deformation by an external force. However, the fastener regulates the separation in the stacked direction around the holes into which the convex portion is fitted. Therefore, the insulation distance between the edges of the holes of the first electrical conductive member 30 and the second electrical conductive member 31 is kept constant by the thickness of the electrical insulating member 32.

Further, the cut-off member 15 such as a fuse is attached to the first slit 40 of the first electrical conductive member 30 and the second slit 41 of the second electrical conductive member 31.

In the present embodiment, the ground contact 14 can prevent an overcurrent from flowing through the electrical conductive bearing 13 and prevent the fixing device 5 from igniting. Further, even if the cut-off member 15 is detached from the first electrical conductive member 30 or the second electrical conductive member 31, the electrical insulating member 32 can prevent the fixing device 5 from igniting and suppress the heat roller 10 from being charged to a high potential during the image forming operation.

The ground contact 14 is composed of the first electrical conductive member 30 and the second electrical conductive member 31. The electrical insulating member 32 is placed between the first electrical conductive member 30 and the second electrical conductive member 31. Accordingly, an appropriate electrical insulating resistance can be provided between the electrical conductive bearing 13 of the heat roller 10 and the ground. That is, when a high voltage is applied between the first electrical conductive member 30 and the second electrical conductive member 31, an electrical discharge is generated between the edges of the holes and the potential difference is reduced.

The thickness of the electrical insulating member 32 defines 0.5 mm of distance between the first surface facing the first electrical conductive member 30 and the second surface facing the second electrical conductive member 31. As a result, even if 240 V (AC) is applied to the fixing device 5 from the power supply section, the fixing device 5 can be suitably insulated and the static electricity of the heat roller 10 can be appropriately discharged. The electrical insulating member 32 may be formed of a sheet member having a thickness of 0.5 mm, or may be formed by stacking two sheet members each having a thickness of 0.25 mm.

The sheet ejecting section 6 ejects the sheet to the outside of the housing of the image forming apparatus 1. The sheet ejecting section 6 may include an ejection roller and an exit tray. The ejection roller ejects the sheet conveyed by the conveyance rollers from the fixing device 5 to the exit tray. The ejected sheet is loaded on the exit tray.

The power supply section supplies electric power to each section of the image forming apparatus 1. In particular, the power supply section supplies electric power to the filament 21 of the fixing device 5.

The driver drives each section of the image forming apparatus 1. In particular, the driver drives the press roller 11 of the fixing device 5. An example of the driver is a motor.

The controller controls each section of the image forming apparatus 1. In particular, the controller controls the power supplied to the heater 12 of the fixing device 5 and the temperature of the heater 12. An example of the controller is a central processing unit (CPU).

An Embodiment of the present disclosure has been described above with reference to the accompanying drawings. However, the present disclosure is not limited to the above embodiment and can be implemented in various manners within a scope not departing from the gist thereof. The drawings mainly illustrate various constituent elements schematically for ease of understanding. The number of the constituent elements illustrated in the drawings may differ in practice for convenience of drawing preparation. The constituent elements illustrated in the above embodiment are one example and not particular limitations. Various alterations can be made within a scope not substantially deviating from the effects of the present disclosure.

What is claimed is:

1. A fixing device, configured to heat and fix a toner image formed on a sheet to the sheet, comprising:

a heat roller that heats the toner image formed on the sheet;

a ground contact that grounds the heat roller; and a housing, wherein the ground contact includes:

a first electrical conductive member that is electrically connected to the heat roller;

a second electrical conductive member that grounds the heat roller via the first electric conductive member; and an electrical insulating member that is interposed between the first electrical conductive member and the second electrical conductive member and that insulates the first electrical conductive member and the second electrical conductive member from each other, the electrical insulating member is a sheet member having a predetermined thickness, and interposed between the first electrical conductive member that faces a first surface of the electrical insulating member and the second electrical conductive member that faces a second surface of the electrical insulating member, the housing includes a convex portion that allows the ground contact to be attached thereto, and each of the first electrical conductive member, the second electrical conductive member, and the electrical insulating member includes a hole into which the convex portion is to be fitted.

2. The fixing device according to claim 1, further comprising:

an electrical conductive bearing that supports the heat roller with the heat roller allowed to turn freely; and a heater that is supplied with electric power from a power supply section to generate heat and heat the heat roller, wherein the ground contact suppresses, through the electrical insulating member, an overcurrent that is generated by the electric power supplied to the heater to flow through the electrical conductive bearing.

3. The fixing device according to claim 2, wherein:

the heater includes a filament that is supplied with the electric power from the power supply section to generate heat; and the ground contact suppresses the overcurrent that is generated by the filament touching the heat roller to flow through the electrical conductive bearing.

4. The fixing device according to claim 1, further comprising a cut-off member that is placed between the first electrical conductive member and the second electrical conductive member and that cuts off an overcurrent flowing through the fixing device, wherein:

the first electrical conductive member has a first slit that supports a first end of the cut-off member; and the second electrical conductive member has a second slit that supports a second end of the cut-off member.

5. An image forming apparatus, comprising the fixing device according to claim 1.

6. A fixing device, configured to heat and fix a toner image formed on a sheet to the sheet, comprising:

a heat roller that heats the toner image formed on the sheet;

a ground contact that grounds the heat roller; and a cut-off member, wherein the ground contact includes:

a first electrical conductive member that is electrically connected to the heat roller;

a second electrical conductive member that grounds the heat roller via the first electric conductive member; and an electrical insulating member that is interposed between the first electrical conductive member and the second electrical conductive member and that insulates the first electrical conductive member and the second electrical conductive member from each other, the electrical insulating member is a sheet member having a predetermined thickness, and interposed between the first electrical conductive member that faces a first surface of the electrical insulating member and the second electrical conductive member that faces a second surface of the electrical insulating member, the cut-off member is placed between the first electrical conductive member and the second electrical conductive member and cuts off an overcurrent flowing through the fixing device, the first electrical conductive member has a first slit that supports a first end of the cut-off member, and the second electrical conductive member has a second slit that supports a second end of the cut-off member.

7. An image forming apparatus comprising the fixing device according to claim 6.

* * * * *